US006557785B1

(12) United States Patent
Knapp

(10) Patent No.: US 6,557,785 B1
(45) Date of Patent: May 6, 2003

(54) SHOWERHEAD FOR DELIVERING AN AERATED WATER STREAM BY USE OF THE VENTURI EFFECT

(75) Inventor: Alfons Knapp, Biberach/Riss (DE)

(73) Assignee: Masco Corporation, Taylor, MI (US)

( * ) Notice: Subject to any disclaimer, the term of this patent is extended or adjusted under 35 U.S.C. 154(b) by 0 days.

(21) Appl. No.: 09/831,448

(22) PCT Filed: Nov. 15, 1999

(86) PCT No.: PCT/US99/27045

§ 371 (c)(1),
(2), (4) Date: Aug. 21, 2000

(87) PCT Pub. No.: WO00/30759

PCT Pub. Date: Jun. 2, 2000

(30) Foreign Application Priority Data

Nov. 19, 1998 (IT) ..... TO98A00973

(51) Int. Cl.[7] ..... B05B 7/06; E03C 1/08

(52) U.S. Cl. ..... 239/428.5; 239/311; 239/318; 239/502; 239/504; 239/523; 239/524; 239/530; 239/589

(58) Field of Search ..... 239/502, 504, 239/311, 318, 518, 523, 524, 428.5, 548, 530, 589, 575

(56) References Cited

U.S. PATENT DOCUMENTS

| | | | | | |
|---|---|---|---|---|---|
| 3,286,935 | A | * | 11/1966 | Corlett et al. | 239/428.5 |
| 3,520,481 | A | * | 7/1970 | Meon | 239/428.5 |
| 3,768,735 | A | * | 10/1973 | Ward | 239/428.5 |
| 3,884,418 | A | * | 5/1975 | Ritzenthaler et al. | 239/428.5 |
| 4,346,844 | A | * | 8/1982 | Harmony | 239/428.5 |
| 4,523,718 | A | * | 6/1985 | Pearson | 239/428.5 |

* cited by examiner

*Primary Examiner*—Robin O. Evans
(74) *Attorney, Agent, or Firm*—Kwadjo Adusei-Poku; Lloyd D. Doigan

(57) ABSTRACT

The showerhead (10) includes a main housing (12) that forms the central supply inlet (16), a supply passage section (20) for the central inlet and a peripheral deflector (22). A disc (26) is applied to the main housing (12). The Venturi passages (40) are made up between housing (14) and the disc (26). A showerhead (10) is intended to deliver an aerated stream of water that has passed through and has been aerated by Venturi passages 40. The Venturi passages (40) radially extend from the supply inlet (16) toward the periphery (22) of the head (14). An air intake passage (44) communicates with the ambient exterior and also communicates with the Venturi passage between its nozzle (50) and diffuser (52). The deflector (22) is arranged to divert the aerated stream of water coming out of the individual Venturi passages in order to deliver them in substantially axial direction perpendicular to the plane (29) of the showerhead.

19 Claims, 3 Drawing Sheets

SHOWERHEAD FOR DELIVERING AN AERATED WATER STREAM BY USE OF THE VENTURI EFFECT

TECHNICAL FIELD

This invention is related to a showerhead intended to deliver an aerated stream of water that is aerated by a background of the disclosure Venturi device.

BACKGROUND OF THE DISCLOSURE

There are showerheads in which the incoming water is aerated by a single device based on the Venturi effect that produces a single stream of aerated water. However, for a Venturi device to be effective, the diffuser of the Venturi device must have a considerable longitudinal (i.e. axial) dimension when compared to its cross-sectional area. The cross-sectional area in known showerheads is significant because it must provide the passage of the entire and significant flow of water of the shower. The great axial dimension becomes an obstacle when it comes to constructing a manual hand held shower to the point where it is no longer practical for use in a manual hand held setting. Furthermore, this type of Venturi showerhead delivers a single stream of water, which is not broken up and which is relatively compact. Although the water stream is aerated, it is not at all pleasant to the users. Furthermore, because of the relatively significant cross-section of the water flow that runs through the diffuser, the aeration obtained is intensive in the outer periphery of the water stream but is rather scant in the central region of the water stream.

Therefore, what is desired is a showerhead that uses the Venturi effect to aerate the water stream and has a size that substantially corresponds with other conventional hand held showers. What is needed is a showerhead that is capable of delivering a divided fractionated or broken stream of aerated water, which is pleasant to the user. What is also needed is a shower that provides substantially uniform aeration for the entire water stream. What is also desired is a shower that can be expeditiously and inexpensively manufactured and that has little vulnerability to deposits of lime.

SUMMARY OF THE INVENTION

In accordance with one aspect of the invention, a showerhead for delivering an aerated water stream includes, a housing with an axially extending supply inlet and at least one Venturi passage radially extending outward from said inlet for receiving water from said supply inlet. At least one air intake passage is in communication with intermediate section of a respective at least one Venturi passage between a respective nozzle and diffuser of said Venturi passage.

Each intake passage is also in communication with ambient atmosphere. A deflector is positioned downstream from an outer outlet end of the Venturi passage to deflect the aerated water stream exiting the Venturi passage to a direction generally transverse to an exit plane of the showerhead housing and in a generally axial direction. Preferably, the deflector includes a rounded rim in a peripheral portion of the housing that gradually directs the aerated water stream toward the axial direction. It is also preferred that the deflector has protrusions protruding radially inward therefrom for subdividing the aerated water stream. Alternatively the deflector includes an inclined surface in a peripheral portion of the housing that reflects the aerated water stream at an angle.

In one embodiment the Venturi passageway has a substantial arcuate extent circumferentially said supply inlet. The deflector also has a substantial accurate extent circumferentially about the supply inlet to deflect the aerated stream into a generally axial direction to form a substantially tubular aerated stream that exits the showerhead housing. Preferably, a plurality of air intake passages is spaced circumferentially about the supply inlet and has a respective downstream end in communication with the Venturi passage. Preferably, a disc member is connected to the housing and positioned axially downstream from the supply inlet. The Venturi passages are formed between the housing and the disc member. The air intake passages extend through one of said disc and the housing. In one embodiment the housing has an extending handle for manual gripping.

In accordance with another aspect of the invention, the Venturi passages are preferably formed by grooves in a face of one of the disc and housing that faces the others of the disc and housing.

BRIEF DESCRIPTION OF THE DRAWINGS

Reference is now made to the accompanying drawings in which.

DETAILED DESCRIPTION OF THE PREFERRED EMBODIMENT

Figure 1:
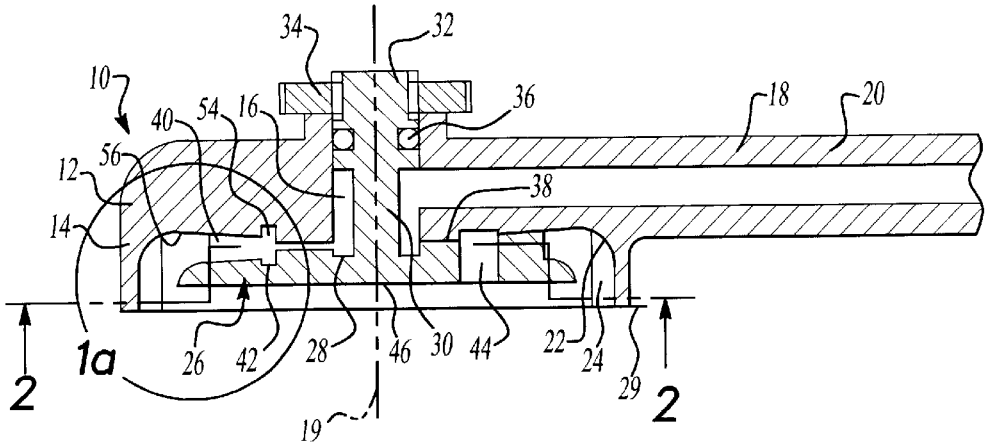
FIG. 1 is a segmented fragmentary side elevational view of a showerhead according to the invention.
Figure 1A:
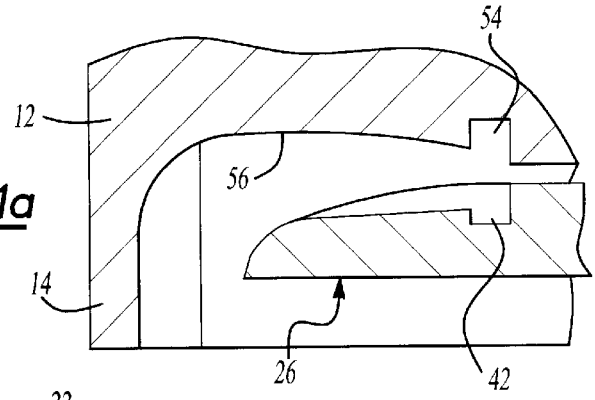

Referring now to FIGS. 1 to 4, a showerhead 10 according to the invention comprises a main housing 12. The housing 12 as a head section 14 with a central passage 16 for the flow of water and an elongated handle section 18 serving as a manual grip for the showerhead 10 if it is intended to be used manually or as support for a fixed installation. A passage 20 runs through the handle section 18 that supplies water to the central inlet passage 16. The central passage 16 extends along a longitudinal axis 19 that is centered with respect to the head section 14. The inside periphery 22 of head section 14 is rounded and serves as deflector for an aerated water stream. Protrusions 24 radially extend inwardly from the inside periphery 22 and breaks up the aerated water streams.

A disc 26 connects to the housing 12 has a central inlet region 28 aligned under the inlet passage 16 in the housing 12. An upwardly extending pin 30 passes through inlet passage 16 and has a threaded section part 32 that connects to the head section 14 of the housing 12 via a threaded cap 34. An appropriate sealing gasket 36 is interposed therebetween. With this arrangement, cap 34 can be used not only to assemble the parts, but also to adjust within certain limits the axial positions of disc 26 with respect to head section 14 of the showerhead.

Figure 2:
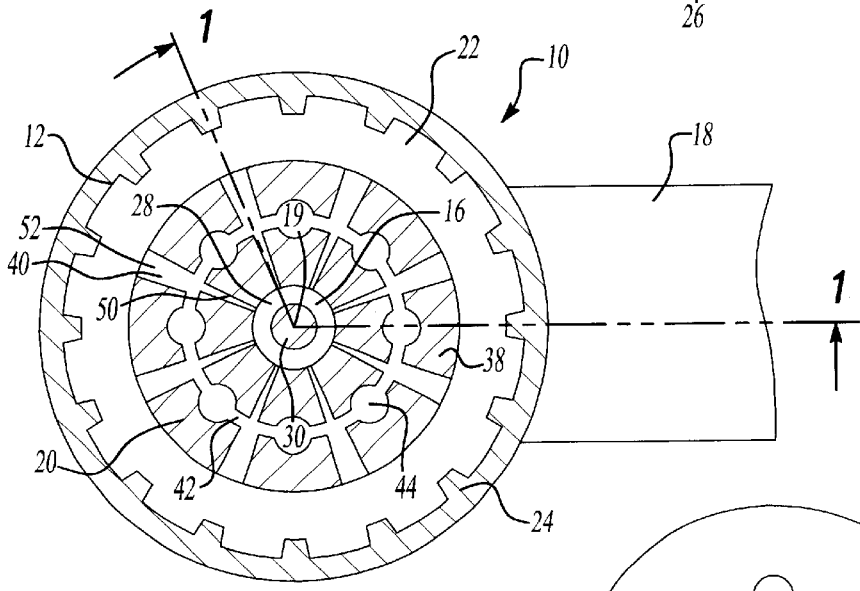
FIG. 2 is a cross-section al view of the showerhead shown in FIG. 1 taken along lines II—II in FIG. 1.
Figure 3:
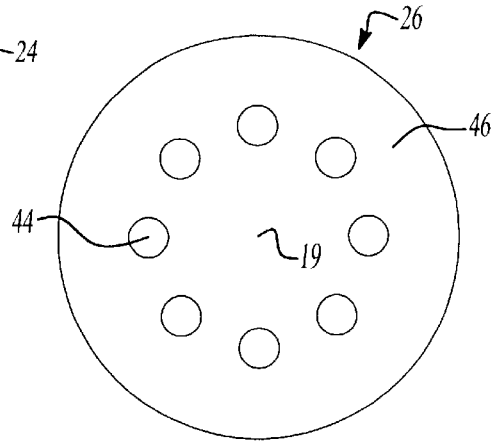
FIG. 3 is a bottom plan view of the disc of the showerhead.
Figure 4:
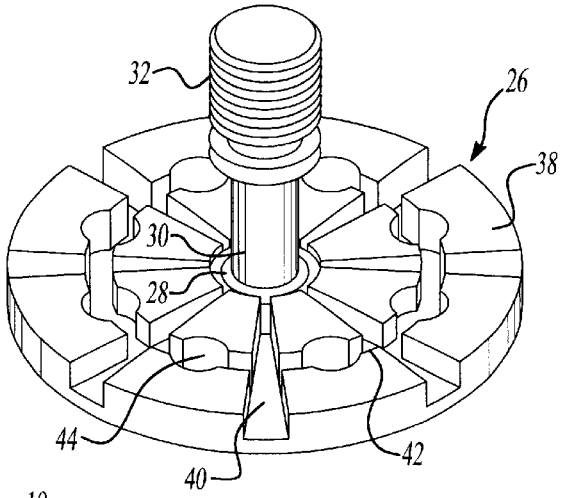
FIG. 4 is a top perspective view of the disc of the showerhead shown in FIGS. 1 to 3.

As clearly shown in FIGS. 2 and 4, the internal face 38 of disc 26 has a plurality of radially diverging Venturi passages 40. The Venturi passages 40 are circumferentially spaced about axis 19. Each passage 40 is intersected in its intermediate section by an annular duct 42 which are also in communication with a plurality of air intake passages 44 which are open to the ambient environment. The air intake passages 44 extend out of outer face 46 of disc 26 as shown in FIG. 3 and are circumferentially spaced about the center longitudinally axis 19. The section 50 of each passages 40 that are between the central inlet region 28 and annular duct 42 forms the inlet nozzle of a Venturi passage 40. The section 52 of each Venturi passage 40 that is peripheral to the annular ducts 42 forms the diffuser of a Venturi passage 40. The intersection zone between each Venturi passageway 40 and annular duct 42 is the restricted cross-section of the Venturi passage.

In operation, pressurized water is sent through supply passageway 20 and to central inlet passage 16 and to central inlet region 28. The water runs through the nozzles 50 of the Venturi passages 40 taking on higher speed by virtue of the reduction of the nozzle cross-section and passing into the restricted section at the intersection of passage 40 with the annular duct 42. Air is aspirated from the ambient environment through air passages 44 and annular duct 42 and is then incorporated into the water stream that then becomes aerated and runs through the peripheral diffuser sections 52 of the Venturi passages 40. The water stream leaves the Venturi passages 40 from the periphery of disc 26 so that all of the aerated streams together will get deflected by periphery 22 of housing head section 14 to a direction that is at least approximately transverse to the exit plane 29 and along axis 19 of the showerhead and will form an aerated broken stream of water. Protrusions 24 cause a further breakup of the water streams.

Advantageously (as one can see in FIG. 1), an annular duct 54, similar to and aligned with annular duct 42 made in disc 26, can also be sunk into the internal face 56 of the head section 14 of the showerhead 10 to facilitate the formation and aeration of the water streams. If applicable, other holes having the same function as holes 14 can be provided in the main body of the shower in order to permit also the respective annular duct to aspire air from the environment. As one can readily see, the constructions described for the internal surface 38 of disc 26 could, on the other hand, or also, entirely or in part, be made in the internal face 56 of showerhead section 14 with an equivalent effect.

As one can see in FIG. 4, the section of radial Venturi passages 40 is illustrated as a square or rectangle, and this shape facilitates making the dies, but this cross-section can also advantageously be at least approximately circular, especially if is it is made half in the internal face 38 of disc 26 and half in the internal face 56 of housing 12 of the showerhead 10.

The showerhead 10 according to the invention does not have any part like the perforated surface of usual showerheads that might develop deposits of lime that could cause deterioration in the operation of the showerhead with the passage of time.

Figure 5:
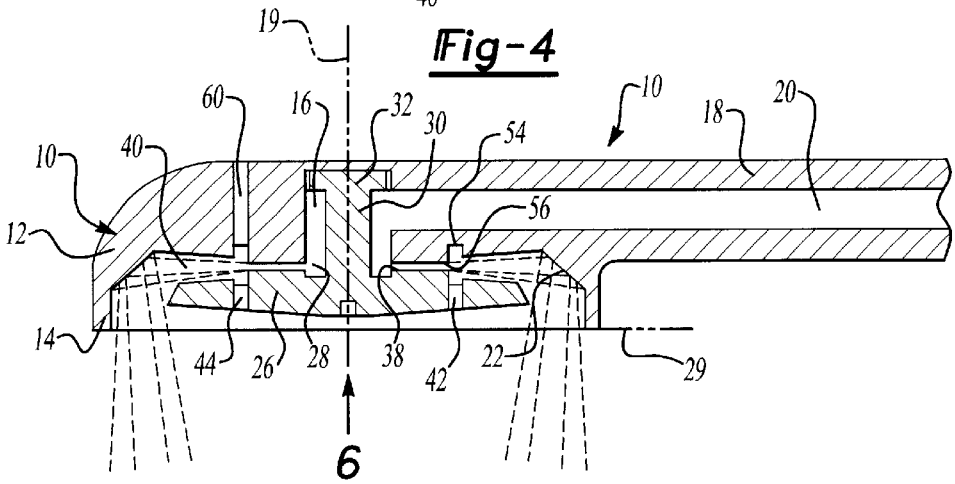
FIG. 5 is a view similar to FIG. 1 illustrating a second embodiment of the showerhead according to the invention.
Figure 6:
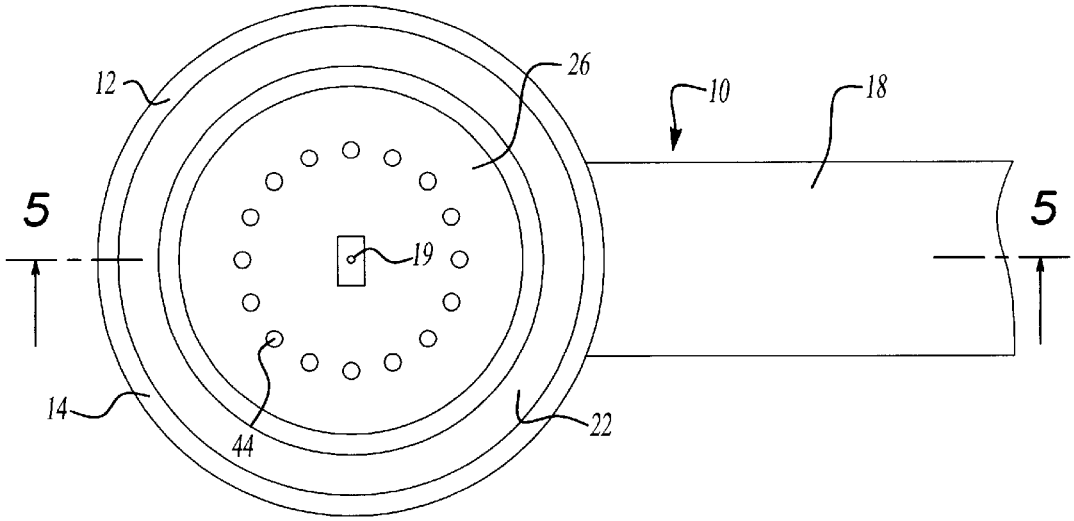
FIG. 6 is a bottom plan view of the showerhead shown in FIG. 5.

Reference now is made to FIGS. 5 and 6, which discloses an alternate embodiment. This embodiment, instead of providing several separate divergent Venturi passages as in the preceding embodiment, has a single laminar passageway 40 that radially extends outward from axis 19 and a substantially arcuate extent about the central passage 16. The passage 40 is formed both in its radial extent and in its arcuate extent by the configuration of the opposing faces 38 and 56 of disc 26 and housing 12 of the showerhead 10. As we can readily see, this singular laminar passageway can be theoretically viewed from the preceding one as a limit of it when the number of circumferentially spaced and radially extending passageways 40 tends toward infinity and when the width of the separation between the passageways 40 approach zero. The operation remains substantially the same, but the showerhead delivers a single laminar aerated annular stream, which after having been deflected by the deflector 22 becomes tubular in shape. A similar stream can be felt by a user as equivalent to a plurality of broken aerated streams. If protrusions 24 are provided on the periphery of head stream 14 as seen in FIGS. 1 and 2, then the protrusions can enhance breakup of the tubular laminar aerated stream.

In this embodiment, pin 30 of disc 28 has its end 32 screwed directly into housing 12 of the showerhead 10 to ensure a correct spacing between the opposing faces 38 and 56 that form the substantially laminar annular passageway 40. The spacing is needed to be correct to provide proper functioning of the Venturi passageway 40. This alternate construction can be adopted also for the first embodiment described earlier.

As we can see in FIG. 5, the flow deflector 22 instead of being made can take on the shape of inclined surface which, instead of gradually diverting the stream, reflects it in the desired angled direction.

FIG. 5 also air intake passages 60 through the housing 12 for the aspiration of ambient air, as was emphasized already with regard to the first embodiment.

Figure 7:
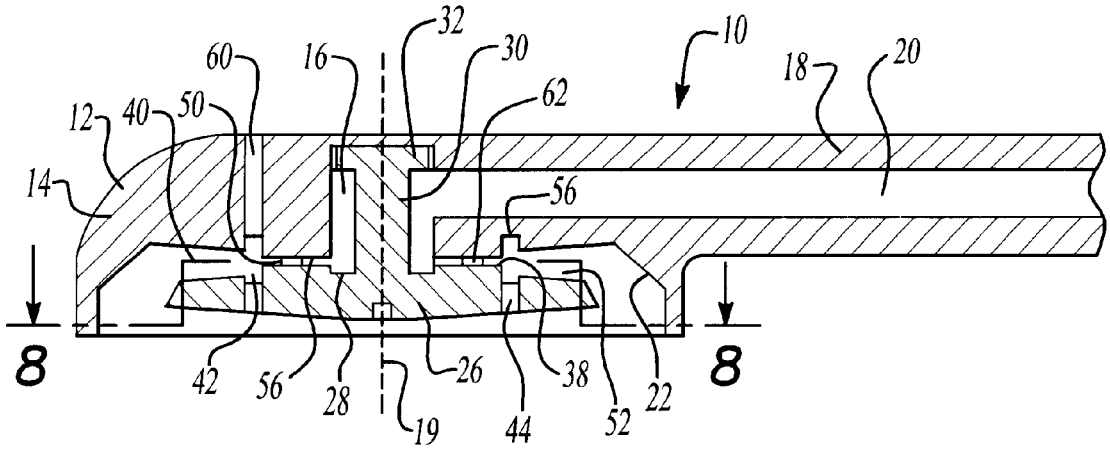
FIG. 7 is a view similar to FIG. 1 illustrating a third embodiment of the showerhead according to the invention.
Figure 8:
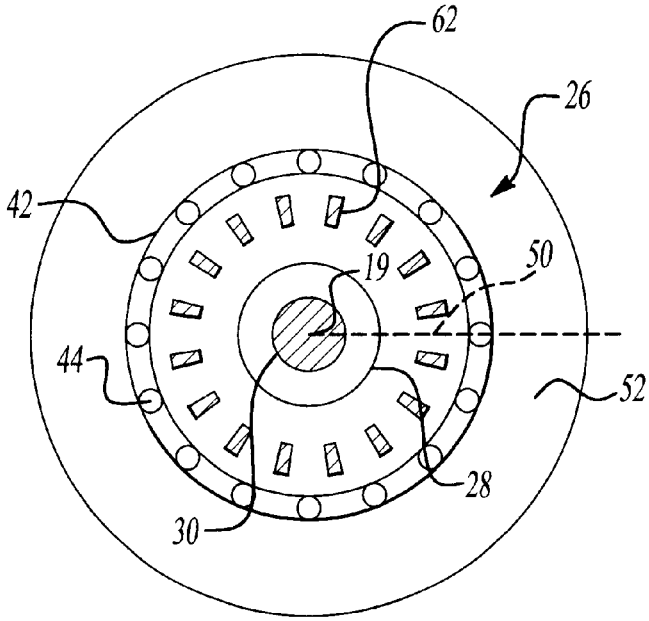
FIG. 8 is a partial cross-sectional view of the disc taken along lines VIII—VIII in FIG. 7.

The embodiment shown in FIGS. 7 and 8 can be considered as a variation of the embodiment illustrated in FIGS. 5 and 6. It differs from the second embodiment only by virtue of the fact that small projections 62 protrude from disc 26 toward the internal opposing face 56 or main housing 12 of the showerhead (or vice versa). The main object of these projections 62 is to establish an expeditious manner for precisely spacing the face 38 from face 56 of housing 12 form that the Venturi passageway 40 pipe and preventing any possible deformations or vibrations of the parts. Furthermore, these projections 62 also achieve the effect of subdividing the aerated and laminar water stream into a plurality of broken aerated streams.

Other variations and modifications are foreseen without departing from the spirit of scope of the invention as defined by the appended claims.

I claim:

1. A showerhead for delivering an aerated water stream, said showerhead characterized by:

a housing with an axially extending supply inlet;

at least one Venturi passage radially extending outward from said inlet for receiving water from said supply inlet;

at least one air intake passage in communication with intermediate section of a respective at least one Venturi passage between a respective nozzle and diffuser of said Venturi passage;

said at least one air intake passage also being in communication with the ambient atmosphere;

a deflector downstream from an outer outlet end of said Venturi passage to deflect said aerated water stream exiting said Venturi passage to a direction generally transverse to an exit plane of said showerhead housing and in a generally axial direction.

2. A showerhead as defined in claim 1 further characterized by;

said at least one Venturi passageway has a substantial arcuate extent circumferentially about said supply inlet;

said deflector also has a substantial arcuate extent circumferentially about said supply inlet to deflect said aerated stream into a generally axial direction to form a substantially tubular aerated stream that exits said showerhead housing.

3. A showerhead as defined in claim 2 further characterized by:

a plurality of air intake passages being spaced circumferentially about said supply inlet and having a downstream end in communication with said at least one Venturi passage.

4. A showerhead as defined in claim 3 further characterized by:

a disc member being connected to said housing and positioned axially downstream from said supply inlet;

said at least one Venturi passage formed between said housing and said disc member;

said air intake passages extending through one of said disc and said housing.

5. A showerhead as defined in claim 4 further characterized by;

said deflector includes a rounded rim in a peripheral portion of said housing that gradually directs the aerated water stream toward the axial direction.

6. A showerhead as defined in claim 5 further characterized by:

said deflector having protrusions protruding radially inward therefrom for subdividing the aerated water stream.

7. A showerhead as defined in claim 4 further characterized by;

said deflector includes an inclined surface in a peripheral portion of said housing that reflects the aerated water stream at an angle.

8. A showerhead depended on claim 7 further characterized by:

said deflector having protrusions protruding radially inward therefrom for subdividing the aerated water stream.

9. A showerhead as defined in claim 4 further characterized by:

one of said housing and disc having a set of projections interposed between the housing and disc member for establishing the height of said at least one Venturi passageway and to subdivide water flow within said at least on Venturi passageway.

10. A showerhead as defined in claim 4 further characterized by:

said housing has an extending handle for manual gripping.

11. A showerhead for delivering an aerated water stream, said showerhead characterized by:

a housing with an axially extending supply inlet;

a plurality of Venturi passages circumferentially spaced about said supply inlet and radially extending outward from said supply inlet for receiving water from said supply inlet;

a plurality of air intake passages circumferentially spaced about said supply inlet and in communication with ambient atmosphere and in communication with an intermediate section of a respective Venturi passage between a nozzle and a diffuser of said respective Venturi passage;

a deflector in a perimeter section of said housing for deflecting said aerated water stream exiting said Venturi passages to a direction generally transverse to an exit plane of said showerhead housing and in a generally axial direction.

12. A showerhead as defined in claim 11 further characterized by:

a disc member being connected to said housing axially downstream from said supply inlet;

said Venturi passages formed by grooves in one of said disc and housing and formed by the groove interposed between said disc and housing;

said air intake passages extending through one of said disc and housing.

13. A showerhead as defined in claim 12 further characterized by:

said air passages having inlet ends circumferentially interposed between said Venturi passages and outlets of said air passage laterally in communication with a respective Venturi passage.

14. A showerhead as defined in claim 13 further characterized by:

said inlets of air passages having communication with an annular duct that communicates with said Venturi passages;

said annular duct being in one of the disc and housing.

15. A showerhead dependent on claim 14 further characterized by;

said deflector includes a rounded rim in a peripheral portion of said housing that gradually directs the aerated water stream toward the axial direction.

16. A showerhead dependent on claim 15 further characterized by;

said deflector having protrusions protruding radially inward therefrom for subdividing the aerated water stream.

17. A showerhead dependent on claim 14 further characterized by;

said deflector comprises an inclined surface in a peripheral portion of said housing that reflects the aerated water stream at an angle.

18. A showerhead dependent on claim 14 further characterized by:

said housing has an extending handle for manual gripping.

19. A showerhead for delivering an aerated water stream, said showerhead characterized by:

a housing with an axially extending supply inlet;

a disc member being connected to said housing and positioned axially downstream from said supply inlet;

a plurality of Venturi passageways formed between said housing and said disc member, and extending radially outward from said inlet for receiving water from said supply inlet, said Venturi passageways having substantially arcuate shapes and extending circumferentially about said supply inlet;

a plurality of air intake passages in communication with intermediate sections of corresponding Venturi passageways between a corresponding nozzle and diffuser of said Venturi passageways;

said air intake passages extending through one of said disc and said housing, and being in communication with ambient atmosphere;

a deflector downstream from an outer outlet end of said Venturi passage to deflect said aerated water stream exiting said Venturi passage to a direction generally transverse to an exit plane of said showerhead housing and in a generally axial direction, said deflector having a substantially arcuate shape and extending circumferentially about said supply inlet; and wherein one of said housing and disc having a set of projections interposed between the housing and disc member for establishing the height of said at least one Venturi passageway and to subdivide water flow within said at least one Venturi passageway.

* * * * *